US008201931B2

(12) United States Patent
Akatsuka et al.

(10) Patent No.: US 8,201,931 B2
(45) Date of Patent: Jun. 19, 2012

(54) LIQUID EJECTING APPARATUS

(75) Inventors: Yasushi Akatsuka, Higashichikuma-gun (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 344 days.

(21) Appl. No.: 12/571,207

(22) Filed: Sep. 30, 2009

(65) Prior Publication Data

US 2010/0079567 A1 Apr. 1, 2010

(30) Foreign Application Priority Data

Oct. 1, 2008 (JP) ..... 2008-256078
Jul. 31, 2009 (JP) ..... 2009-179232

(51) Int. Cl.
*B41J 2/175* (2006.01)

(52) U.S. Cl. ..... 347/85

(58) Field of Classification Search ..... 347/84, 347/85, 92

See application file for complete search history.

(56) References Cited

U.S. PATENT DOCUMENTS

| | | | | |
|---|---|---|---|---|
| 6,315,402 | B1 * | 11/2001 | Kawase | 347/85 |
| 7,311,761 | B2 | 12/2007 | Ishizawa et al. | |
| 7,344,230 | B2 * | 3/2008 | Moynihan | 347/85 |
| 7,674,322 | B2 | 3/2010 | Ishizawa et al. | |
| 7,841,706 | B2 * | 11/2010 | Ishinaga et al. | 347/84 |
| 7,909,443 | B2 * | 3/2011 | Hirato | 347/85 |

FOREIGN PATENT DOCUMENTS

| | | |
|---|---|---|
| CN | 101219605 A | 7/2008 |
| JP | 03-036037 A | 2/1991 |
| JP | 2005-028686 | 2/2005 |

* cited by examiner

*Primary Examiner* — Anh T. N. Vo
(74) *Attorney, Agent, or Firm* — Workman Nydegger

(57) ABSTRACT

A liquid ejecting apparatus includes: a liquid containing chamber that contains liquid; a depressurizing unit that brings the liquid contained in the liquid containing chamber to a boil at reduced pressure; and an air open valve that opens an inner chamber space of the liquid containing chamber to air after the boiling of the liquid at reduced pressure.

7 Claims, 11 Drawing Sheets

LIQUID EJECTING APPARATUS

BACKGROUND

1. Technical Field

The present invention relates to a liquid ejecting apparatus that has a function of liquid agitation utilizing the boiling of liquid at reduced pressure.

2. Related Art

Some printing apparatuses, which is an example of various types of liquid ejecting apparatuses, use ink that contains a color component that is insoluble or hardly soluble in a solvent. For example, in pigment-based ink, fine particles of pigment are dispersed as a color component in a solvent such as water, a petroleum solvent, or the like. Accordingly, the pigment is apt to precipitate. For example, the specific gravity of white pigment is approximately four. The specific gravity of metallic pigment is approximately two to three. In contrast, the specific gravity of a solvent is less than one. Since a difference between the specific gravity of the pigment and the specific gravity of the solvent is greater than one, the pigment is apt to separate from the solvent and thus precipitate.

In addition, dye is apt to precipitate in some dye ink that contains insoluble dye or hardly soluble dye as a color component. When the color component of ink precipitates, light and dark color-density irregularities occur in the ink. Therefore, in such a case, it is impossible or difficult to supply ink having uniform concentration to a head. A portion of the ink that has greater density might clog the nozzles, which results in a difficulty in discharging ink drops from the nozzles. As another problem, the luminance of dots might deviate.

In an effort to provide a solution to these problems, a technique for agitating (i.e., stirring) ink by means of a plurality of float-and-sink bodies that are present in ink contained in an ink-containing chamber has been proposed as disclosed in JP-A-2005-28686. Specifically, according to the related art disclosed in JP-A-2005-28686, the ink-containing chamber contains the float-and-sink bodies, which change in volume in accordance with a change in the pressure of ink, together with the ink. A pressurizing pump changes the inner pressure of the ink-containing chamber so that the float-and-sink bodies float and sink in the ink. The ink is agitated through the movement of the float-and-sink bodies.

In the related art disclosed in JP-A-2005-28686, the ink-containing chamber is supposed to contain more than one float-and-sink body. Therefore, the ink capacity of the ink-containing chamber decreases by the aggregate volume of the float-and-sink bodies. As another disadvantage, there is a risk that the float-and-sink bodies will block an ink drain port, which is less reliable. As another disadvantage, the float-and-sink bodies might not diffuse well to reach the inner corners of the ink-containing chamber. Therefore, there is a possibility that ink cannot be agitated at the corners completely.

SUMMARY

An advantage of some aspects of the invention is to provide a liquid ejecting apparatus that is capable of agitating liquid contained in a liquid containing chamber with a simple structure without containing any agitating object such as float-and-sink bodies in the liquid containing chamber.

In order to overcome the above-identified disadvantages without any limitation thereto, a liquid ejecting apparatus according to a first aspect of the invention includes: a liquid containing chamber that contains liquid; a depressurizing section that brings the liquid contained in the liquid containing chamber to a boil at reduced pressure; and an air open valve that opens an inner chamber space of the liquid containing chamber to air after the boiling of the liquid at reduced pressure.

With the configuration of a liquid ejecting apparatus according to the first aspect of the invention, when the depressurizing section brings liquid contained in the liquid containing chamber to a boil at reduced pressure, the liquid evaporates to produce air bubbles. The air bubbles go up in the liquid toward the liquid surface. Therefore, the liquid contained in the liquid containing chamber is agitated. That is, a liquid ejecting apparatus according to the first aspect of the invention makes it possible to agitate the liquid contained in the liquid containing chamber with a simple structure without containing any agitating object such as float-and-sink bodies in the liquid containing chamber. In addition, since the liquid containing chamber is aerated, that is, opened to air by opening the air open valve after the agitation of the liquid, it is possible to eliminate the air bubbles formed in the liquid quickly.

It is preferable that a liquid ejecting apparatus according to the first aspect of the invention should further include a liquid containing section that is provided inside the liquid containing chamber, at least a part of the liquid containing section having flexibility, wherein the liquid is contained in the liquid containing section inside the liquid containing chamber. With the preferred configuration described above, since the part of the liquid containing section that has flexibility contracts when the liquid containing chamber is opened to air by opening the air open valve after the boiling of the liquid at reduced pressure, it is possible to increase the effects of liquid agitation.

In the preferred configuration of a liquid ejecting apparatus, it is further preferable that the liquid containing section should be made of an air-impermeable member, which is not permeable to air. With the preferred configuration described above, even when air dissolved in the liquid separates from the liquid due to the boiling thereof at reduced pressure, the air does not permeate through the liquid containing section to the outside. Therefore, when the liquid containing chamber is opened to air by opening the air open valve after the boiling of the liquid contained in the liquid containing chamber at reduced pressure, air present in the form of air bubbles inside the liquid containing chamber is dissolved into the liquid rapidly. As a result, turbulence is produced in the liquid. In addition, the liquid containing section contracts. Therefore, it is possible to agitate the liquid effectively.

A liquid ejecting apparatus according to a second aspect of the invention includes: a liquid ejecting head that ejects liquid; a liquid supply passage; a liquid containing chamber that contains the liquid, the liquid containing chamber being in communication with the liquid ejecting head through the liquid supply passage; an air-permeable section through which air can be taken in to be dissolved in the liquid contained in the liquid containing chamber; a depressurizing section that depressurizes an inner chamber space of the liquid containing chamber to form the air dissolved in the liquid contained in the liquid containing chamber into air bubbles; and an air open valve that opens the inner chamber space of the liquid containing chamber to air after the depressurization.

In the configuration of a liquid ejecting apparatus according to the second aspect of the invention, when the depressurizing section depressurizes the inner chamber space of the liquid containing chamber, air is taken in through the air-permeable section to be dissolved in the liquid; and, in addition, the air dissolved in the liquid is formed into air bubbles. The air bubbles go up in the liquid toward the liquid surface.

Therefore, the liquid contained in the liquid containing chamber is agitated. That is, a liquid ejecting apparatus according to the second aspect of the invention makes it possible to agitate the liquid contained in the liquid containing chamber with a simple structure without containing any agitating object such as float-and-sink bodies in the liquid containing chamber. In addition, since the liquid containing chamber is opened to air through the opening of the air open valve after the agitation of the liquid, it is possible to eliminate the air bubbles formed in the liquid quickly. Thus, it is possible to perform liquid ejection from the liquid ejecting head, which is in communication with the liquid containing chamber through the liquid supply passage, with good ejection performance.

It is preferable that a liquid ejecting apparatus according to the second aspect of the invention should further include an open/close valve that is provided at an intermediate position on the liquid supply passage, the open/close valve being able to open or close the liquid supply passage, wherein a part of the liquid supply passage between the liquid containing chamber and the open/close valve is the air-permeable section; and a part of the liquid supply passage between the liquid ejecting head and the open/close valve is an air-impermeable section, which is not permeable to air.

In the preferred configuration described above, since the part of the liquid supply passage between the liquid containing chamber and the open/close valve is the air-permeable section, air dissolved in liquid present in the air-permeable section is diffused and gets dissolved in liquid contained in the liquid containing chamber. The liquid containing chamber is depressurized to form the air dissolved in the liquid contained in the liquid containing chamber into air bubbles. Therefore, it is possible to agitate the liquid contained in the liquid containing chamber effectively by using the air bubbles. In addition, since the part of the liquid supply passage between the liquid ejecting head and the open/close valve is the air-impermeable section, which is not permeable to air, it is possible to prevent air from being dissolved in the liquid supply passage near the liquid ejecting head.

It is preferable that a liquid ejecting apparatus according to the second aspect of the invention should further include a liquid containing section that is provided inside the liquid containing chamber, at least a part of the liquid containing section being made of an air-permeable member, which is permeable to air, wherein the liquid is contained in the liquid containing section inside the liquid containing chamber; and the part of the liquid containing section that is made of the air-permeable member constitutes a part of the air-permeable section.

With the preferred structure described above, it is possible to increase the amount of air dissolved in the liquid contained in the liquid containing section. Therefore, it is possible to achieve greater liquid agitation effects when air bubbles are formed in the liquid due to depressurization.

It is preferable that a liquid ejecting apparatus according to the second aspect of the invention should further include a pressurizing section that pressurizes the inner chamber space of the liquid containing chamber, wherein the depressurizing section depressurizes the inner chamber space of the liquid containing chamber to form the air dissolved in the liquid contained in the liquid containing chamber into air bubbles after the pressurization of the inner chamber space of the liquid containing chamber by the pressurizing section.

With the preferred configuration described above, since air dissolved in liquid contained in the liquid containing section is formed into air bubbles due to the depressurization of the liquid containing chamber after the increasing of the amount of the air dissolved in the liquid contained in the liquid containing chamber with air taken in through the air-permeable section due to the pressurization of the liquid containing chamber, it is possible to achieve greater effects of agitating the liquid contained in the liquid containing chamber utilizing the air bubbles formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
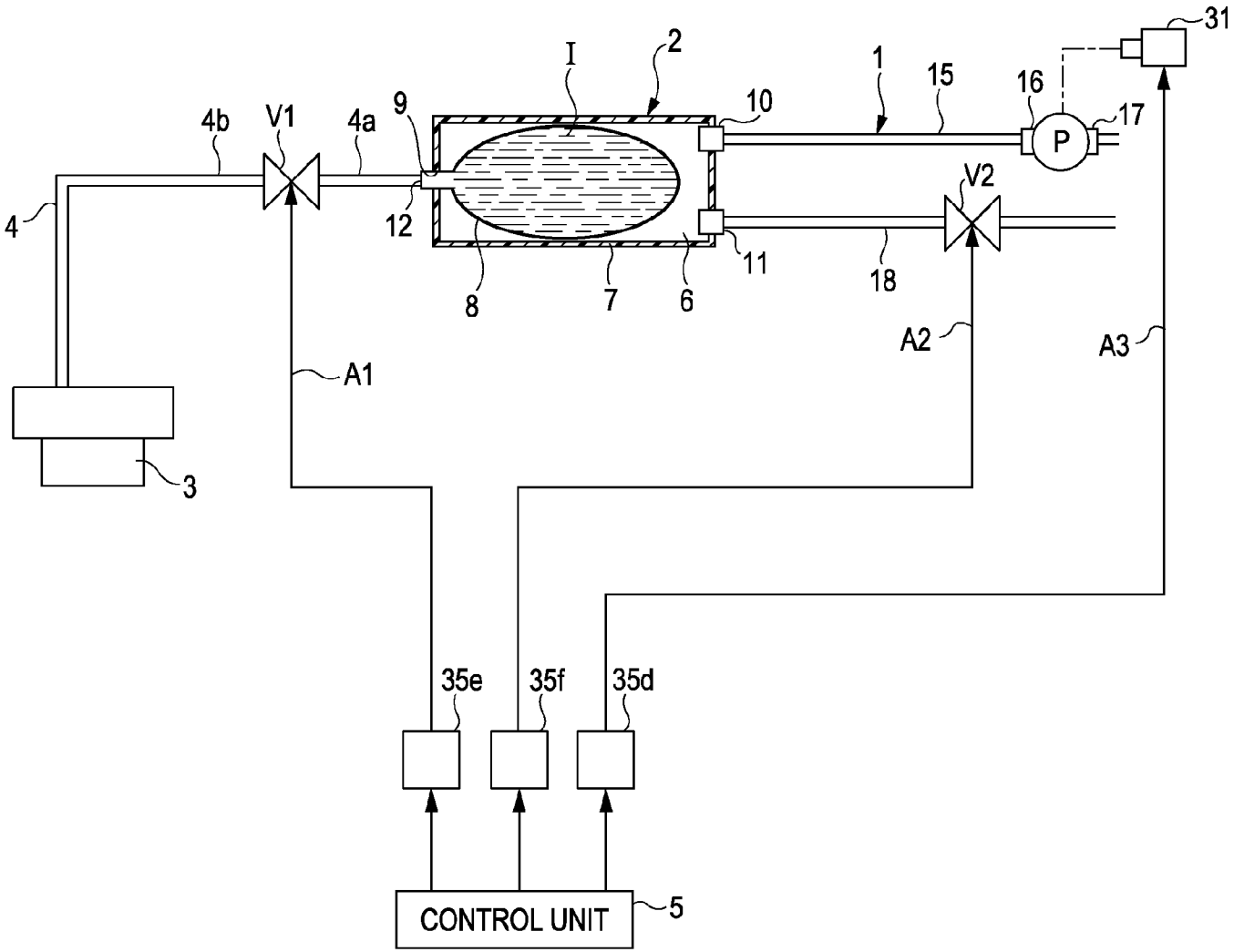
FIG. 1 is a diagram that schematically illustrates an example of the configuration of a printing apparatus according to an exemplary embodiment of the invention.
Figure 3:
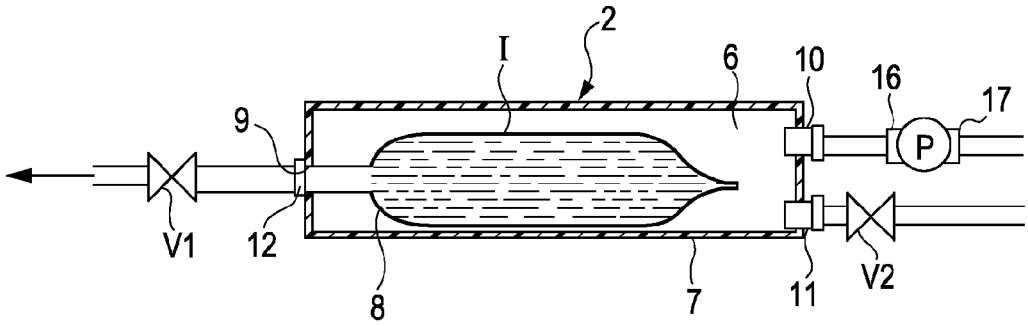
FIG. 3 is a diagram that schematically illustrates an example of the configuration of an ink cartridge and other components according to an exemplary embodiment of the invention.

With reference to the accompanying drawings, a printing apparatus according to an exemplary embodiment of the invention will now be explained in detail. FIG. 1 is a diagram that schematically illustrates an example of the configuration of a printing apparatus according to an exemplary embodiment of the invention. FIG. 3 also shows an example of the configuration of the printer. As illustrated in FIGS. 1 and 3, a printing apparatus 1, which is an example of a liquid ejecting apparatus according to an aspect of the invention, is provided with an ink cartridge (hereinafter simply referred to as a "cartridge") 2, a head 3, an ink supply passage 4, a pressurizing/depressurizing pump P, an outlet valve V1, an air open valve V2, and a control unit 5. The cartridge 2 contains ink I, which is an example of various kinds of liquid. The reference letter "I" of the ink I is omitted hereinafter. The cartridge 2 is an example of a liquid containing chamber (e.g., "room") according to an aspect of the invention. The head 3 is an example of a liquid ejecting head according to an aspect of the invention. The cartridge 2 is in communication with the head 3 through the ink supply passage 4, which is an example of a liquid supply passage according to an aspect of the invention. The pressurizing/depressurizing pump P is an example of a pressurizing section and a depressurizing section according to an aspect of the invention.

Figure 4:
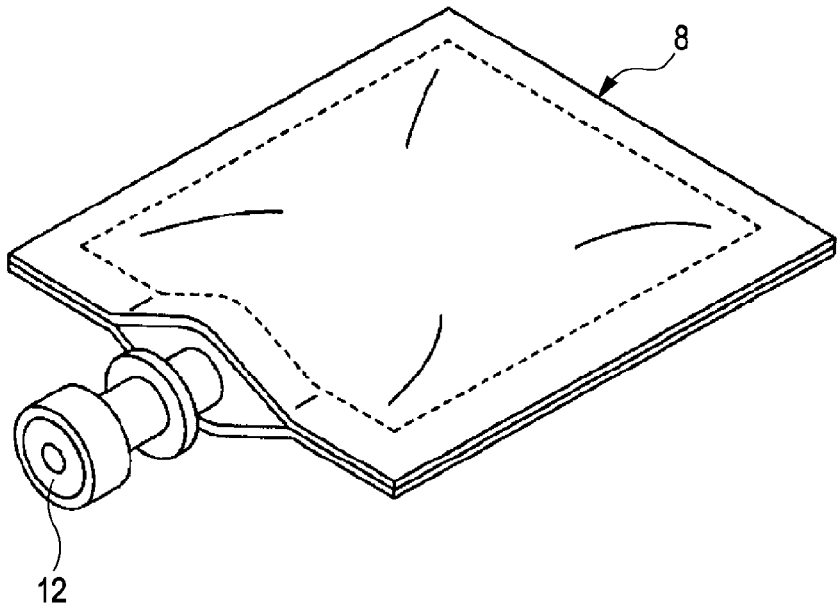
FIG. 4 is a perspective view that schematically illustrates an example of the configuration of a containing bag according to an exemplary embodiment of the invention.

The cartridge 2 is detachably attached to the attachment base of the printing apparatus 1. The cartridge 2 includes a container 7 and a containing bag 8 (refer to FIG. 4). A pressure chamber 6 is formed as the inner space of the container 7. The containing bag 8 is provided in the container 7. The pressure space 6 surrounds the containing bag 8. The containing bag 8 is an example of a liquid containing section according to an aspect of the invention. The container 7 is made of a hard material such as rigid plastic. The container 7 is provided with a container's ink porthole 9, an air inlet/outlet port 10, and a release port 11. A bag's ink port member 12, which will be explained later, is supported at the container's ink porthole 9. The container's ink porthole 9 is an ink porthole that is a part of the container 7. The release port 11 is a port through which the pressure chamber 6 can be aerated, that is, communicated with the outside. The pressure chamber 6 is in communication with the outside through the air inlet/outlet port 10, too.

The containing bag 8 is a thin bag that is made of a material that has flexibility and air/gas non-permeability, which means that the containing bag 8 is not permeable to air or any other gas. Examples of such a material having flexibility and air/gas non-permeability are butyl rubber, polysulfide rubber, epichlorohydrin rubber, high nitrile rubber, fluorocarbon rubber, and so forth. The material of the containing bag 8 having air/gas non-permeability is an example of an air-impermeable member according to an aspect of the invention. Being made of the material explained above, the containing bag 8 has variable ink capacity. The bag's ink port member 12 is provided on the containing bag 8. The bag's ink port member 12 is fixed to the container 7 through the container's ink porthole 9. The bag's ink port member 12 is not covered by the chassis of the container 7 and thus exposed to the outside. One end of the ink supply passage 4 is connected to the bag's ink port member 12 provided on the containing bag 8. Therefore, the containing bag 8 is in communication with the ink supply passage 4.

When the cartridge 2 is in mint condition, a sealing film that is not illustrated in the drawing seals the bag's ink port member 12. An ink supply needle that is not illustrated in the drawing is provided at the one end of the ink supply passage 4. When the cartridge 2 is attached to the printing apparatus 1, the ink supply needle pierces the sealing film. Ink contained in the containing bag 8 of the cartridge 2 flows through an inner passage of the ink supply needle, which has a hollow structure, and then through the ink supply passage 4. As a result, the ink is supplied to the head 3.

The outlet valve V1 is provided somewhere between the cartridge 2 and the head 3 on the ink supply passage 4. The supply of ink from the cartridge 2 to the head 3 can be stopped through the closing of the outlet valve V1. In addition, the amount of ink supplied from the cartridge 2 to the head 3 can be adjusted through the control of the outlet valve V1. As explained later, the control unit 5 closes the outlet valve V1 when ink contained in the containing bag 8 is "flash boiled", that is, comes to a boil at reduced pressure. In addition, the control unit 5 closes the outlet valve V1 when the cartridge 2 is replaced with new one.

One end of an air supply/evacuation passage 15 is connected to the air inlet/outlet port 10. The other end of the air supply/evacuation passage 15 is connected to one port 16 of the pressurizing/depressurizing pump P. The other port 17 of the pressurizing/depressurizing pump P is open to the outside air. Through the operation of the pressurizing/depressurizing pump P, air (inclusive of gas) can be supplied to (i.e., pumped into) the pressure chamber 6 via the air supply/evacuation passage 15 or pumped out from the pressure chamber 6 via the air supply/evacuation passage 15.

One end of a release airway 18 is connected to the release port 11. The other end of the release airway 18 is open to the outside air. The air open valve V2 is provided somewhere on the release airway 18. It is possible to render the pressure chamber 6 open to the outside air or shut off the pressure chamber 6 from the outside air through the control of the air open valve V2.

Figure 6:
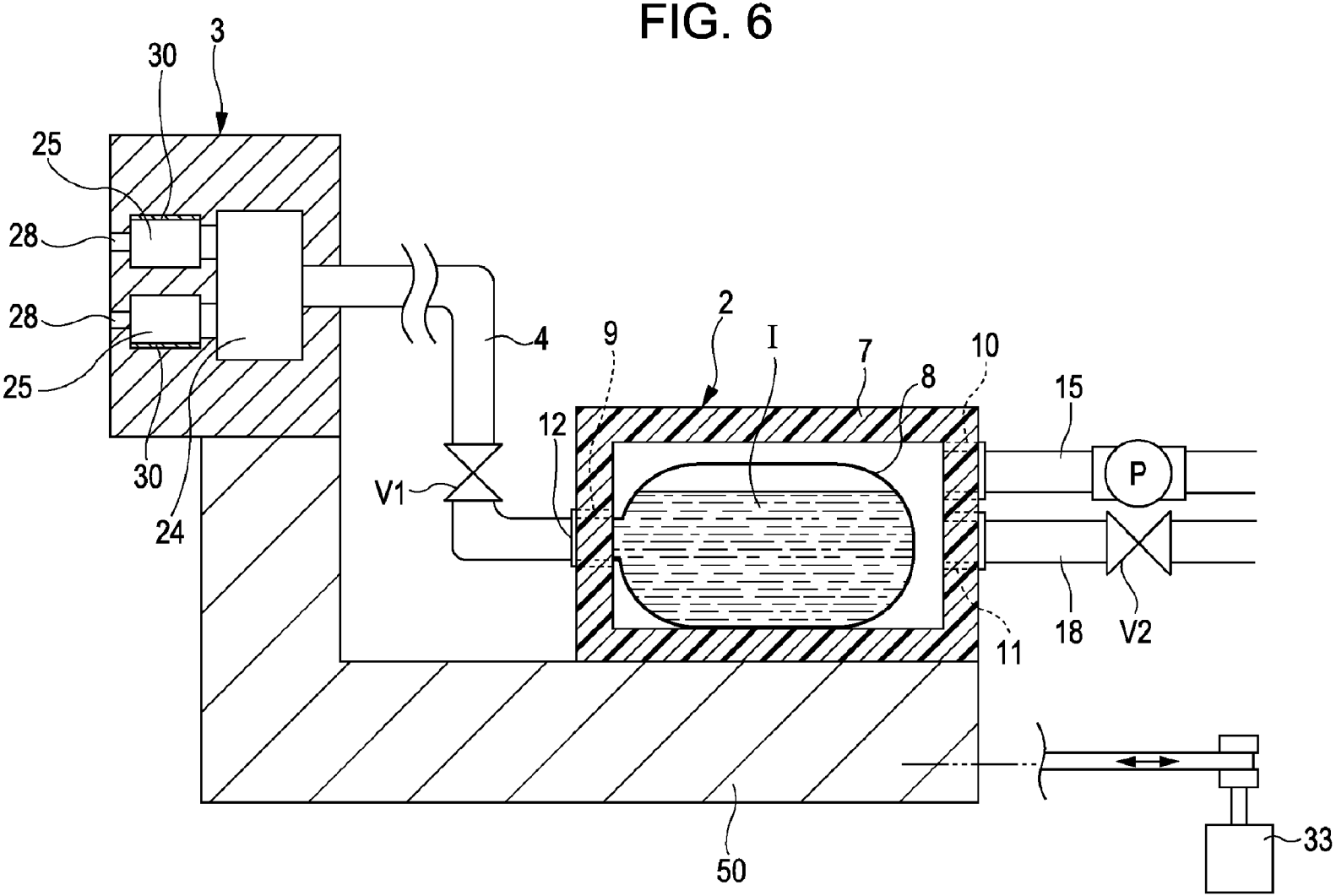
FIG. 6 is a diagram that schematically illustrates an example of the configuration of the ink cartridge and a head according to an exemplary embodiment of the invention.

FIG. 6 is a sectional view that schematically illustrates an example of the configuration of an ink cartridge and a head according to an exemplary embodiment of the invention. The printing apparatus 1 is an on-carriage printer in which the cartridge 2 is mounted on a carriage 50. In the configuration of the on-carriage printer 1 illustrated in FIG. 6, the head 3 is provided with an ink chamber 24, a plurality of pressure chambers (i.e., pressure compartments) 25, a plurality of nozzles 28, and a plurality of actuators 30. The other end of the ink supply passage 4 is connected to one end of the ink chamber 24. Accordingly, the ink supply passage 4 is in communication with the ink chamber 24. One end of each of the pressure chambers 25 is connected to the other end of the ink chamber 24. The other end of each of the pressure chambers 25 is connected to the corresponding nozzle 28. Accordingly, the ink chamber 24 is in communication with each nozzle 28 via the corresponding pressure chamber 25.

The actuator 30 is, for example, a piezoelectric element, a heater element, or the like that is provided on a wall of the pressure chamber 25. Ink supplied from the ink chamber 24 to the pressure chamber 25 forms a concave ink surface (i.e., meniscus) at the exit of the nozzle 28. The ink retained in the nozzle 28 is pressed out through the operation of the actuator 30. The ink pressed out forms into an ink drop. The head 3 ejects ink drops onto a print target medium such as a sheet of paper or the like. In this way, the head 3 performs printing operation. A component denoted with a reference numeral 33 in FIG. 6 is a carriage motor. The carriage motor 33 supplies driving power to move the carriage 50 in the main scan direction.

Figure 2:
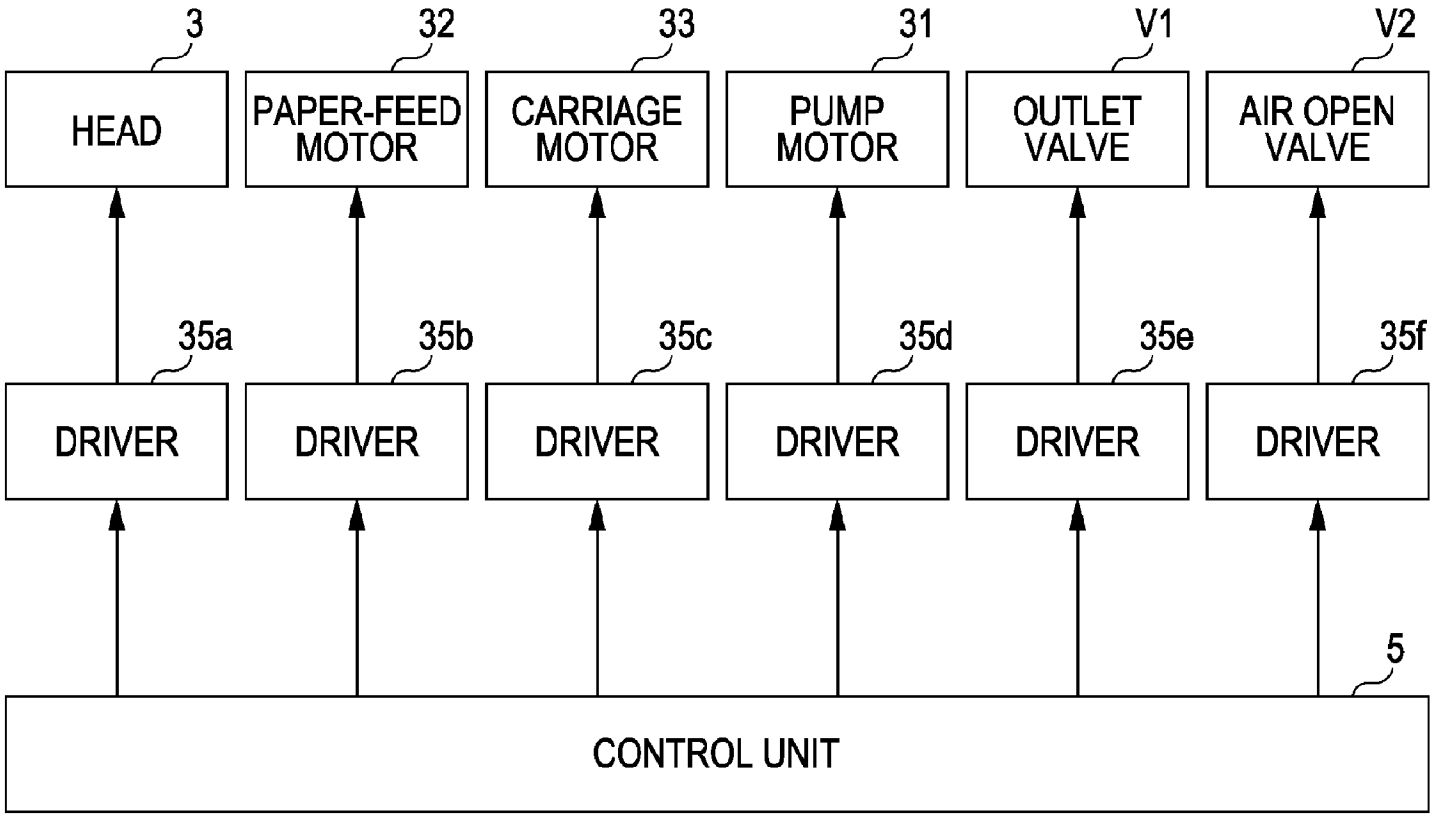
FIG. 2 is a block diagram that schematically illustrates an example of a control relationship between a control unit and control target components according to an exemplary embodiment of the invention.

FIG. 2 is a block diagram that schematically illustrates an example of a control relationship between a control unit and control target components according to an exemplary embodiment of the invention. The control unit 5 controls a pump motor 31, the outlet valve V1, the air open valve V2, the head 3, a paper-feed motor 32, and the carriage motor 33, which are control target components. As illustrated in FIG. 2, the control unit 5 outputs a control signal to each of drivers 35*a*, 35*b*, 35*c*, 35*d*, 35*e*, and 35*f*, which drive the head 3, the paper-feed motor 32, the carriage motor 33, the pump motor 31, the outlet valve V1, and the air open valve V2, respectively. Specifically, as illustrated in FIG. 1, when the control unit 5 outputs a control signal to the driver 35*d*, the driver 35*d* outputs a pump drive control signal A3 to the pump motor 31 so as to control the operation of the pressurizing/depressurizing pump P. When the control unit 5 outputs a control signal to the driver 35*e*, the driver 35*e* outputs an open/close control signal A1 to the outlet valve V1 so as to control the open/close state of the outlet valve V1. When the control unit 5 outputs a control signal to the driver 35*f*, the driver 35*f* outputs an open/close control signal A2 to the air open valve V2 so as to control the open/close state of the air open valve V2.

Figure 7:
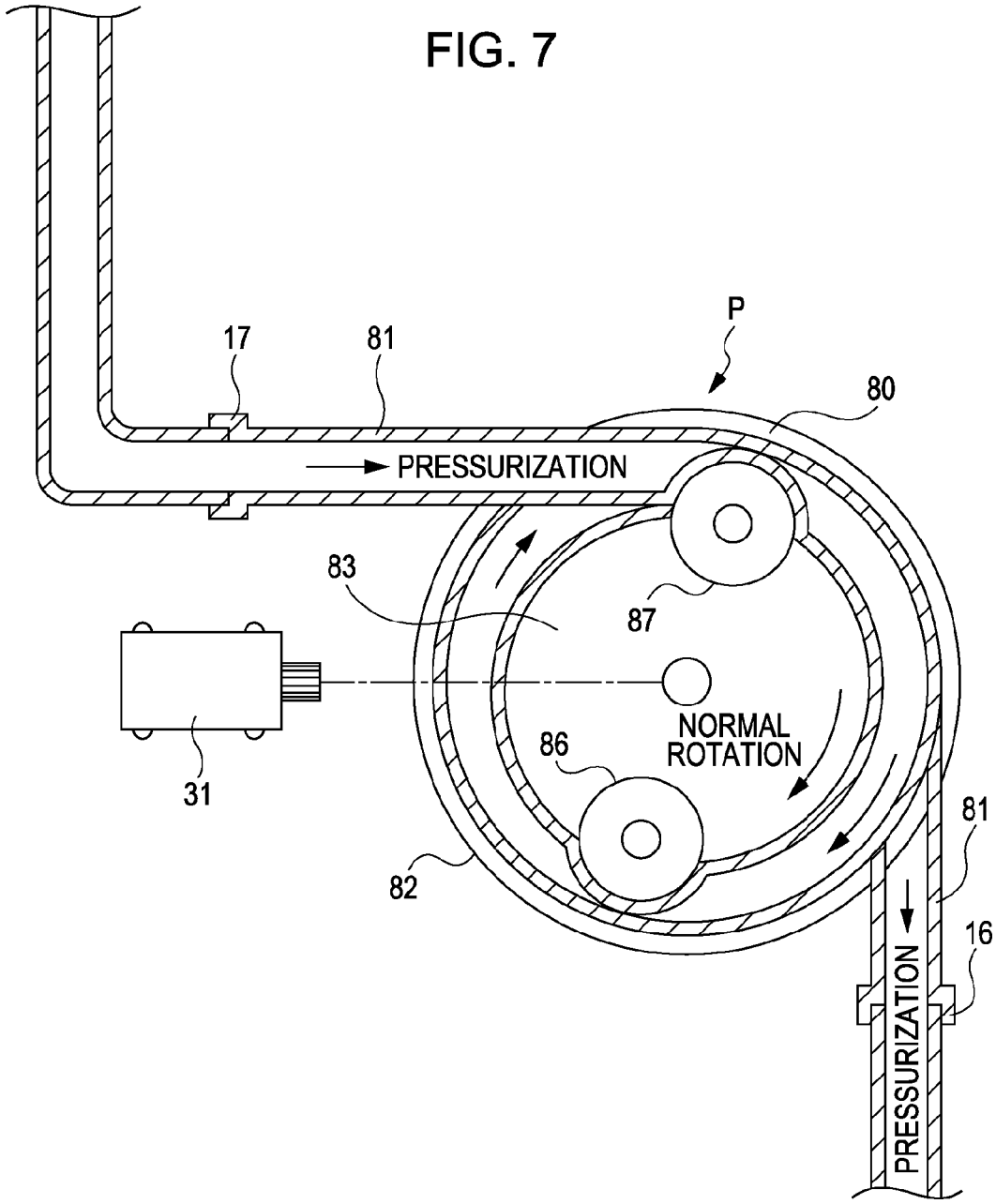
FIG. 7 is a sectional view that schematically illustrates an example of the configuration of a pressurizing/depressurizing pump according to an exemplary embodiment of the invention.

FIG. 7 is a simplified diagram that schematically illustrates an example of the configuration of the pressurizing/depressurizing pump (tube pump) P according to an exemplary embodiment of the invention. As illustrated in FIG. 7, a tube pump 80 can be used as the pressurizing/depressurizing pump P. The tube pump 80 is provided with a tube 81, a pump frame 82, a pump wheel 83, and two rollers 86 and 87. The pump frame 82 has an inner circumferential surface that limits the outward movement of the tube 81. The pump wheel 83 rotates in a normal direction or in a reverse direction when driven by the pump motor 31. Each of the rollers 86 and 87 is rotatably supported at a position on the circumference of the pump wheel 83. The tube 81 is provided in a space between the pump frame 82 and the pump wheel 83 to form a circle along the inner circumferential surface of the pump frame 82. The tube 81 provided in the form of a circle has an overlapping part.

When the pump motor 31 supplies normal-direction motor power to the pump wheel 83 to rotate the pump wheel 83 in the normal direction, the rollers 86 and 87 press the inner air of the tube 81 out toward the cartridge 2. Therefore, the pressure chamber 6 of the cartridge 2 is pressurized. On the other hand, when the pump motor 31 supplies reverse-direction motor power to the pump wheel 83 to rotate the pump wheel 83 in the reverse direction, the rollers 86 and 87 press the inner air of the tube 81 out in the opposite direction, that is, away from the cartridge 2. Therefore, the pressure chamber 6 of the cartridge 2 is depressurized.

To supply ink to the head 3, the control unit 5 drives the pump motor 31 in the normal direction with the outlet valve V1 being opened and the air open valve V2 being closed. As the pump motor 31 rotates in the normal direction when the outlet valve V1 and the air open valve V2 are opened and closed, respectively, the pressurizing/depressurizing pump P applies pressure to the pressure chamber 6. Because of the increased inner pressure of the pressure chamber 6, the containing bag 8 is pressed from the outside. As a result, ink contained in the containing bag 8 is pressed out of the bag 8 and then flows through the ink supply passage 4 to reach the head 3. Printing is performed with the ink supplied in this way.

Next, it is explained how the control unit 5 controls ink agitation operation. The control unit 5 drives the pump motor 31 in the reverse direction with both the outlet valve V1 and the air open valve V2 being closed. As the pump motor 31 rotates in the reverse direction when both the outlet valve V1 and the air open valve V2 are closed, the pressurizing/depressurizing pump P reduces the inner pressure of the pressure chamber 6. The pressure chamber 6 is depressurized until flash boiling occurs, that is, until ink contained in the containing bag 8 comes to a boil at reduced pressure. After the flash boiling of the ink, the air open valve V2 is opened. A depressurization value at which the ink contained in the containing bag 8 boils at reduced pressure is determined depending on ink composition. Therefore, the depressurization value that corresponds to the composition of the ink can be preset. A pressure detection unit, which is not illustrated in the drawing, measures the depressurization value. The pressure detection unit can be provided inside the pressure chamber 6. Or, the pressure detection unit can be provided in the air supply/evacuation passage 15. The control unit 5 judges whether a value inputted from the manometer (i.e., pressure gauge, pressure detection unit) that is not illustrated in the drawing has reached the preset depressurization value or not. When it is judged that the inputted value has reached the preset depressurization value, the control unit 5 stops the driving rotation of the pump motor 31 to stop the pumping operation of the pressurizing/depressurizing pump P and, at the same time, opens the air open valve V2 instantaneously.

When the flash boiling of ink contained in the containing bag 8 occurs under negative pressure, the moisture of the ink evaporates when the ink is, for example, water-based ink. As the moisture of the ink turns into vapor, air bubbles form in the ink. As the air bubbles rise to the surface to be diffused in the atmosphere inside the containing bag 8, the containing bag 8 expands. When the air open valve V2 is opened instantaneously, the inner pressure of the pressure chamber 6 returns to atmospheric pressure. Since the inner pressure of the pressure chamber 6 returns to atmospheric pressure, the air (i.e., water vapor) diffused in the inner space of the containing bag 8 is dissolved into the ink rapidly again. Since the air returns into a dissolved state rapidly, which causes the contraction of the containing bag 8, the ink that is contained in containing bag 8 moves actively. Therefore, the ink contained in containing bag 8 is stirred (i.e., agitated).

Figure 5:
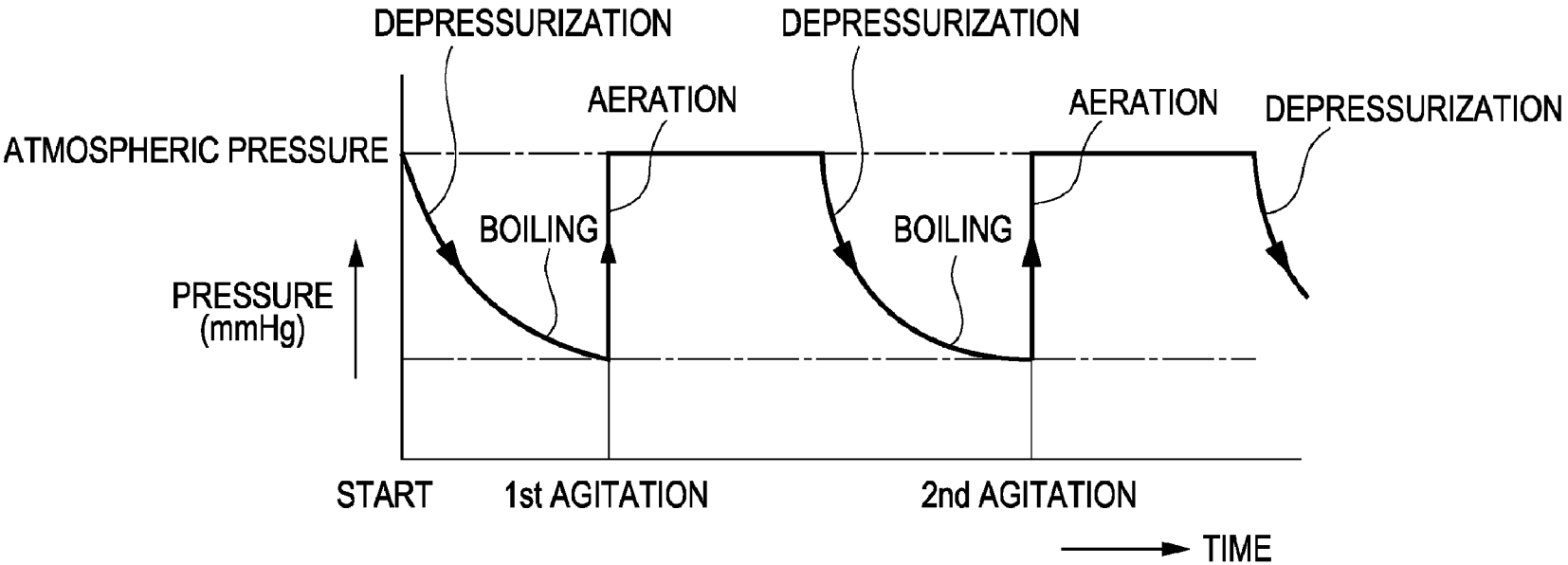
FIG. 5 is a diagram that schematically illustrates an example of ink agitation control according to an exemplary embodiment of the invention.

As illustrated in FIG. 5, if boiling at reduced pressure and subsequent opening to air is not performed just once but repeated more than once, ink agitation occurs repeatedly. The repeated ink agitation produces greater effects.

Specifically, as illustrated in FIG. 5, pressure is reduced to a predetermined depressurization value to cause flash boiling. After the boiling, the depressurized space is opened to air instantaneously. This series of operations is repeated to agitate ink more than once. The repeated ink agitation makes it possible to disperse a pigment that has a large specific gravity in the solvent well. Therefore, the ink subjected to agitation is free from color irregularity. The control unit 5 can perform agitation control after the inputting of a print command but before the execution of print control or at regular time intervals. Although the timing of agitation control for repeating the series of agitating operations can be arbitrarily determined, it is preferable to set the timing as follows. For example, it is preferably executed once, twice, or three times in 24 hours when the head 3 stays at a capping position or when the head 3 is in an inactive/idle state. Or, it is preferably executed once in a day when the head 3 continues to be out of service for several days.

The printing apparatus 1 according to the present embodiment of the invention explained in detail above offers the following advantages.

(1) After the boiling of ink contained in the containing bag 8 at reduced pressure, the pressure chamber 6 is opened to air. The opening of the pressure chamber 6 to air causes the agitation of the ink contained in the containing bag 8. Therefore, it is possible to prevent the pigment particles of the ink from precipitating.

(2) The inner pressure of the pressure chamber 6 can be reduced with the pressurizing/depressurizing pump P, which pressurizes the pressure chamber 6 to supply ink to the head 3. Therefore, it is possible to control both the supplying of ink to the head 3 and the agitation of ink with the use of a single pump, which is economical and contributes to the reduction in the size of an apparatus. The control unit 5 drives the pump motor 31 in the normal direction to supply ink to the head 3. In this normal-direction operation, the pressurizing/depressurizing pump P functions as a pressurizing pump. On the other hand, the control unit 5 drives the pump motor 31 in the reverse direction to agitate ink. In this reverse-direction operation, the pressurizing/depressurizing pump P functions as a depressurizing pump. Since the pressurizing/depressurizing pump P serves both as a pressurizing pump and a depressurizing pump, it is not necessary to provide a pressurizing pump and a depressurizing pump as two discrete components. The pressurizing/depressurizing pump P that doubles as a pressurizing pump and a depressurizing pump is more economical and offers a smaller size.

(3) The containing bag 8, which is an ink containing section, is made of an air-impermeable member. Since the containing bag 8 is made of a material that is not permeable to air or any other gas, when the liquid component of ink is vaporized due to boiling at reduced pressure (i.e., flash boiling), air produced as a result of vaporization does not permeate through the containing bag 8 to the outside. Therefore, it is possible to dissolve the air produced through the vaporization of the liquid component of the ink contained in containing bag 8 due to flash boiling into the ink again by opening the pressure chamber 6 to the outside air so that the inner pressure of the pressure chamber 6 returns to atmospheric pressure. By this means, it is possible to produce turbulence in the ink. Utilizing the turbulence, it is possible to agitate the ink effectively.

(4) The containing bag 8 is made of a flexible material. Therefore, when air produced through the vaporization of the liquid component of ink contained in containing bag 8 due to flash boiling is dissolved into the ink again by opening the pressure chamber 6 to the outside air so that the inner pressure of the pressure chamber 6 returns to atmospheric pressure, the flexible containing bag 8 contracts. The contraction of the containing bag 8 produces turbulence in the ink, which increases the effects of ink agitation.

Other Embodiments

The foregoing exemplary embodiment of the invention may be modified as follows.

Figure 8:
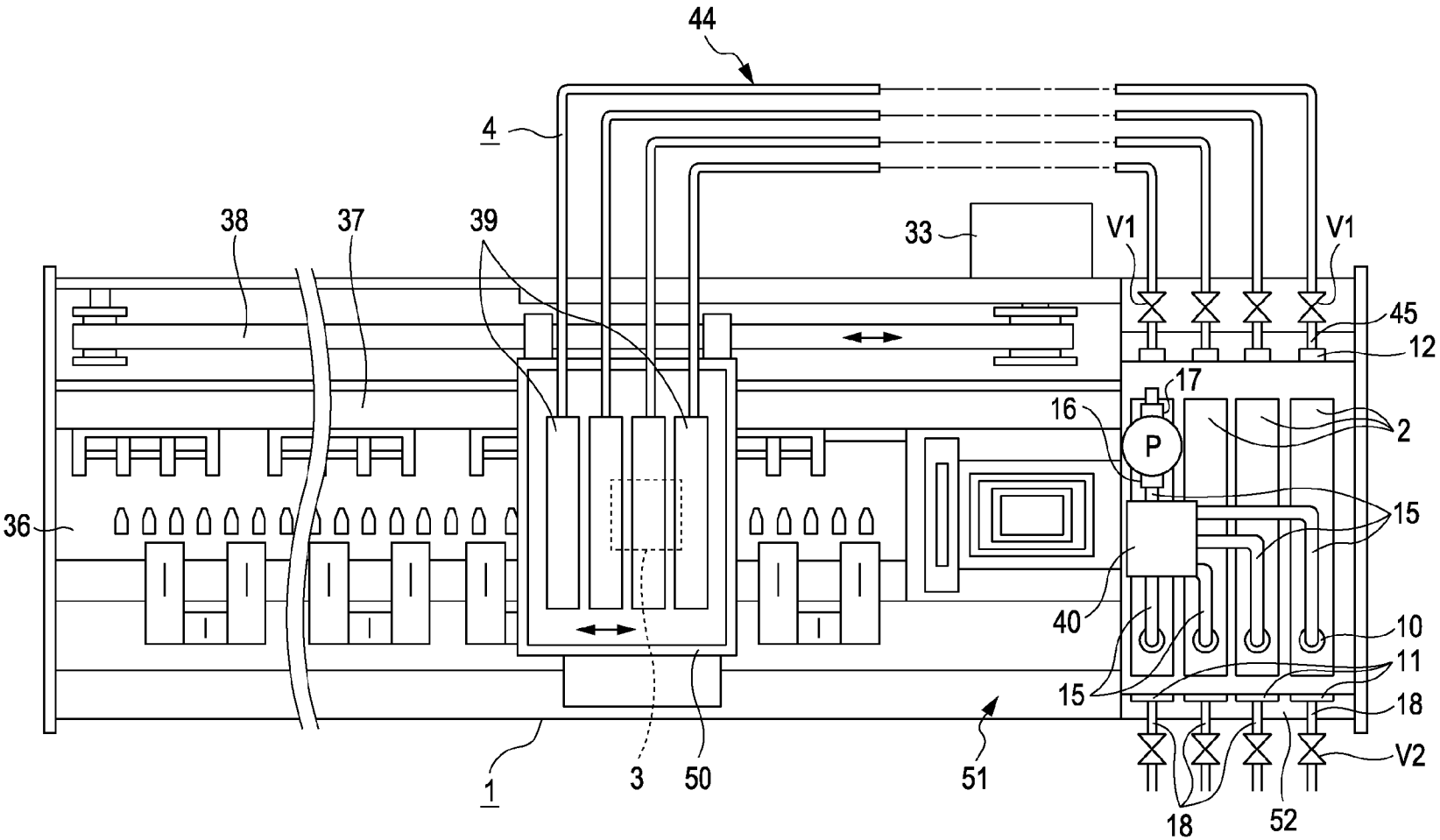
FIG. 8 is a plan view that schematically illustrates an example of the configuration of a printing apparatus according to another exemplary embodiment of the invention.

The printing apparatus 1 may be an off-carriage printer in which the cartridge 2 is not mounted on the carriage 50. As illustrated in FIG. 8, as an example of the configuration of the off-carriage printer 1, the plurality of cartridges 2 each of which corresponds to an ink color is detachably attached to a cartridge attachment portion 52 of a case 51.

In the configuration of the illustrated printing apparatus 1, the pressurizing/depressurizing pump P is provided over the cartridge 2. The carriage 50 to which the head 3 is attached can move along a guiding shaft 37 from side to side. The carriage 50 is fixed to a timing belt 38. The timing belt 38 rotates when driven by the carriage motor 33. A driving force of the carriage motor 33 is transmitted to the carriage 50 via the timing belt 38. The carriage 50 travels along the guiding shaft 37 from side to side when driven by the carriage motor 33.

That is, the carriage 50 is indirectly connected to the carriage motor 33 with the timing belt 38 being provided therebetween. The carriage motor 33 is supported on the back of the case 51. The carriage 50 reciprocates horizontally, which is the main scan direction, along the guiding shaft 37 while receiving driving motor power that is supplied from the carriage motor 33 through the timing belt 38.

A platen 36 is provided in the case 51 along the main scan direction. The platen 36 is a member that is used for supporting a recording target medium, which is not illustrated in the drawing. A paper-feed device transports a recording target medium over the platen 36. The paper-feed device is also not illustrated in the drawing. The head 3 is provided on a surface of the carriage 50 that faces the platen 36. The head 3 is provided with a plurality of nozzles that is not illustrated in the drawing. The head 3 ejects ink as an example of various kinds of liquid from the nozzles toward the platen 36.

A plurality of valve units 39 is mounted on the carriage 50. Ink is temporarily retained in the valve units 39. The valve units 39 supply the ink to the head 3 in a pressure-adjusted state. The air supply/evacuation passage 15 is connected to the one port 16 of the pressurizing/depressurizing pump P. A pressure detection unit 40 is provided on the air supply/evacuation passage(s) 15. The pressure detection unit 40 detects pressure during pressurization and depressurization. The air supply/evacuation passage 15 connected to the one port 16 of the pressurizing/depressurizing pump P branches at the pressure detection unit 40. The branched air supply/evacuation passages 15 are connected to the respective cartridges 2.

The release port 11 of the cartridge 2 and the air open valve V2 are connected to each other through the release airway 18. The release airway 18 is made of a tube. Reference numerals 44 and 45 denote tubes that constitute a part of the ink supply passages 4. One end of each of the plurality of tubes 44 is connected to the corresponding one of the plurality of valve units 39, which is attached to the carriage 50 for controlling the amount of ink supplied to the head 3. The other end of each of the plurality of tubes 44 is connected to the corresponding one of the plurality of outlet valves V1. In addition, one end of each of the plurality of tubes 45 is connected to the corresponding one of the plurality of outlet valves V1. The other end of each of the plurality of tubes 45 is connected to the corresponding one of the plurality of bag's ink port members 12 (refer to FIGS. 1 and 4). The valve units 39 are connected to the head 3 through tubes that are not illustrated in the drawing. The tubes that connect the valve units 39 to the head 3 constitute another part of the ink supply passages 4.

The off-carriage printer 1 having the configuration explained above operates as follows. The control unit 5 drives the pump motor 31 in the normal direction for ink-supplying operation. As the pump motor 31 rotates in the normal direction, the pressurizing/depressurizing pump P applies pressure to each cartridge 2 via the pressure detection unit 40 and the corresponding air supply/evacuation passage 15. Accordingly, ink is pressed out of the cartridge 2 through the bag's ink port member 12. The ink flows through the tube 45, the outlet valve V1, the tube 44, and the valve unit 39 in the order of appearance herein. The outlet valve V1 is preset in an open state. Then, the ink is supplied to the head 3 from the valve unit 39. During the ink-supplying operation explained above, the air open valve V2 is closed.

The control unit 5 closes the outlet valve V1 and drives the pump motor 31 in the reverse direction for ink-agitating operation. As the pump motor 31 rotates in the reverse direction, the pressurizing/depressurizing pump P depressurizes each cartridge 2 via the pressure detection unit 40 and the corresponding air supply/evacuation passage 15. Ink boils when the inner pressure of the cartridge 2 is reduced to a predetermined depressurization value. After the flash boiling of the ink, the air open valve V2 is opened instantaneously. Upon the opening of the air open valve V2, the air (bubbles)

produced through the vaporization of the liquid component of the ink due to the flash boiling is dissolved into the ink again, which produces turbulence in the ink. Accordingly, the ink is agitated because of the turbulence.

Since the pressure detection unit 40 is provided at an intermediate branch point on the air supply/evacuation passage(s) 15, it is possible to set an appropriate value for depressurization for flash boiling on the basis of a signal inputted from the pressure detection unit 40. It is assumed in the foregoing explanation that every cartridge 2 is subjected to flash boiling. Notwithstanding the foregoing, however, flash boiling may be performed selectively for not all but some cartridges 2 that contain ink whose pigment has a large difference in specific gravity from a solvent.

Figure 9:
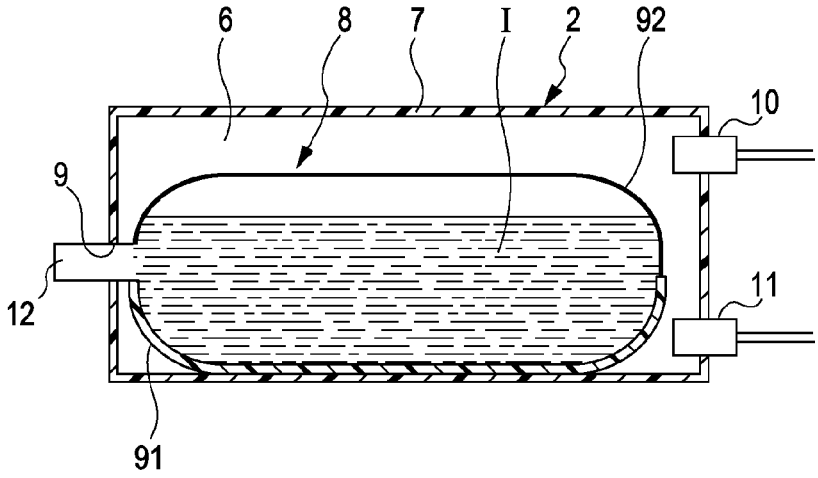
FIG. 9 is a sectional view that schematically illustrates an example of the configuration of an ink cartridge according to another exemplary embodiment of the invention.

As another embodiment, as illustrated in FIG. 9, the containing bag 8 may be made up of a hard part 91, which is shown by a thick line, and a soft part 92, which is shown by a thin line. The hard part 91 of the containing bag 8 is made of a hard material that is not permeable to air or any other gas. An example of such a material is rigid resin. The soft part 92 of the containing bag 8 is made of a flexible material that is also not permeable to air or any other gas. That is, as a modified structure, at least a part of the containing bag 8 is made of a flexible material that is not permeable to air or any other gas. Even with such a modified structure, the same advantageous effects as those explained earlier can be produced.

Figure 10:
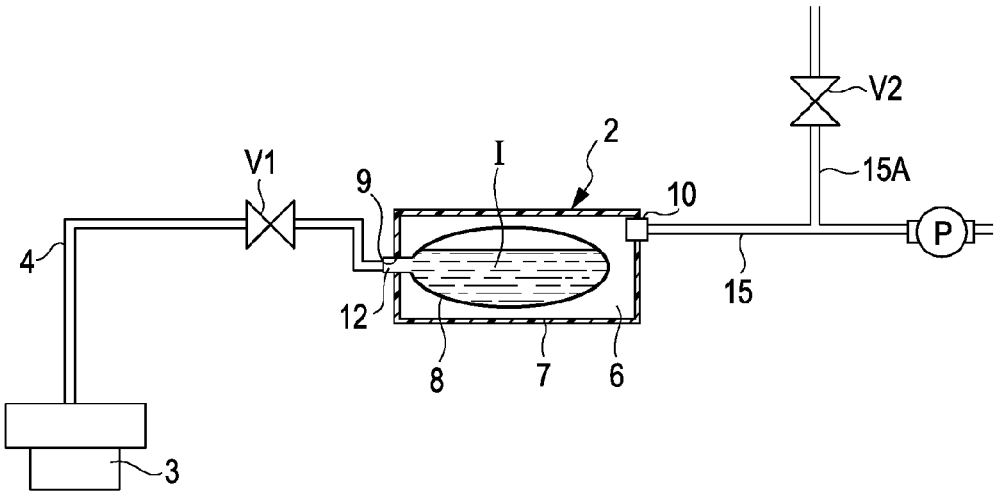
FIG. 10 is a diagram that schematically illustrates an example of the configuration of a printing apparatus according to another exemplary embodiment of the invention.

As still another embodiment, a release airway 15A may be provided in communication with the air supply/evacuation passage 15 as illustrated in FIG. 10. In this modified configuration, the air open valve V2 is provided on the release airway 15A. Even with such a modified configuration, the same advantageous effects as those explained earlier can be produced.

Figure 11:
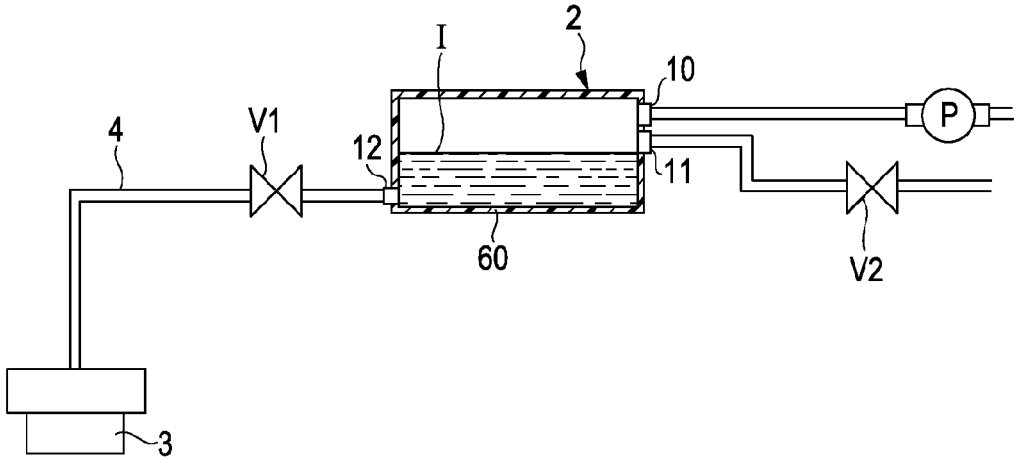
FIG. 11 is a diagram that schematically illustrates an example of the configuration of a printing apparatus according to another exemplary embodiment of the invention.
Figure 12:
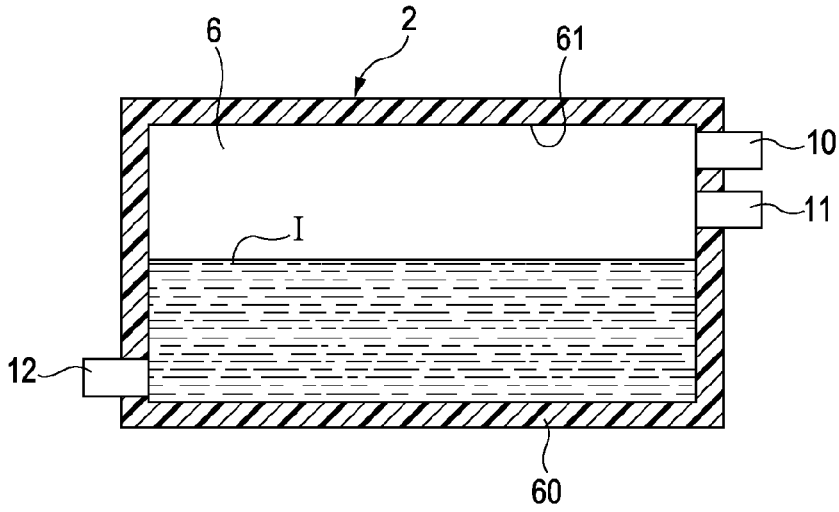
FIG. 12 is a sectional view that schematically illustrates an example of the configuration of an ink cartridge according to another exemplary embodiment of the invention.

As still another embodiment, an ink-containing member of the cartridge 2 that contains ink may be a container 60 that is made of a hard material as illustrated in FIG. 11. That is, in this modified structure, the cartridge 2 is not provided with the containing bag 8. Accordingly, ink is contained in the hard container 60 directly. In this modified structure, a space inside the container 60 serves as a pressure chamber. In addition, as illustrated in FIG. 12, it is preferable that a material that is not permeable to air or any other gas is laminated on the inner wall of the container 60 for hermetic sealing. In this modified structure, it is necessary to make sure that a liquid level is below the air inlet/outlet port 10 and the release port 11 to avoid ink from leaking through the ports 10 and 11.

Figure 13:
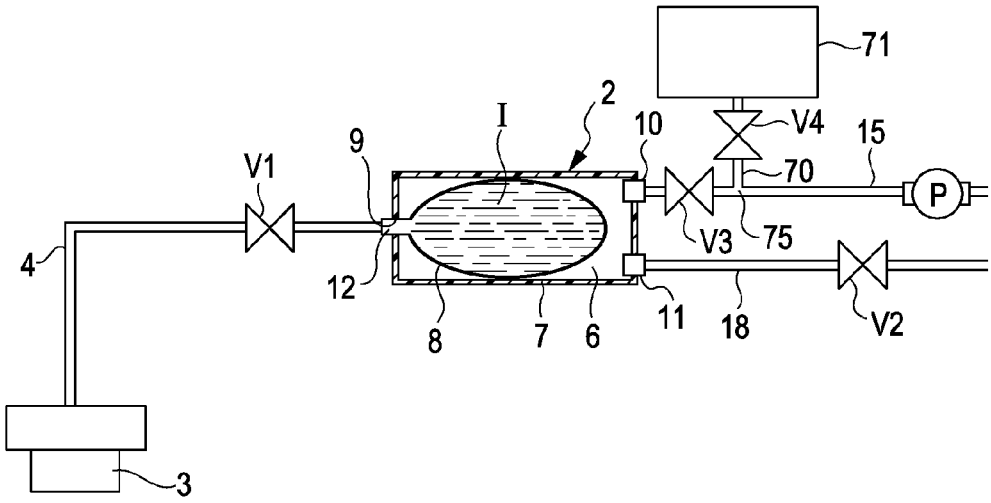
FIG. 13 is a diagram that schematically illustrates an example of the configuration of a printing apparatus according to another exemplary embodiment of the invention.

As still another embodiment, a negative pressure storage unit 71 such as an accumulator may be provided as illustrated in FIG. 13. The control unit 5 drives the pump motor 31 in the reverse direction during a time period other than the ink-supplying period in which ink is supplied to the head 3. As the pump motor 31 rotates in the reverse direction, the pressurizing/depressurizing pump P performs vacuuming operation to pre-accumulate negative pressure in the negative pressure accumulation unit 71. Ink that is contained in the containing bag 8 can be flash boiled with the use of the negative pressure that was accumulated in the negative pressure accumulation unit 71 in advance. The negative pressure accumulation unit 71 is connected to the air supply/evacuation passage 15 through a connection passage 70. Accordingly, the negative pressure accumulation unit 71 is in communication with the air supply/evacuation passage 15. A junction 75 is formed as the intersection of the air supply/evacuation passage 15 and the connection passage 70. A negative pressure control valve V3 is provided on the air supply/evacuation passage 15 between the junction 75 and the air inlet/outlet port 10. Another negative pressure control valve V4 is provided on the connection passage 70.

The control unit 5 drives the pump motor 31 in the reverse direction during a time period other than the ink-supplying period with the negative pressure control valve V3 being closed and the negative pressure control valve V4 being opened. Accordingly, the pressurizing/depressurizing pump P depressurizes the inner space of the negative pressure accumulation unit 71 to make the inner pressure negative. Then, the negative pressure control valve V4 is closed. Subsequently, both the negative pressure control valves V3 and V4 are opened in order to perform ink agitation control. The inner pressure of the pressure chamber 6 is rendered negative with the use of the negative pressure that is pre-accumulated in the negative pressure accumulation unit 71. With the modified configuration explained above, it is possible to bring ink to a boil quickly as may be necessary by utilizing negative pressure that has been accumulated in the negative pressure accumulation unit 71 in advance.

Figure 14:
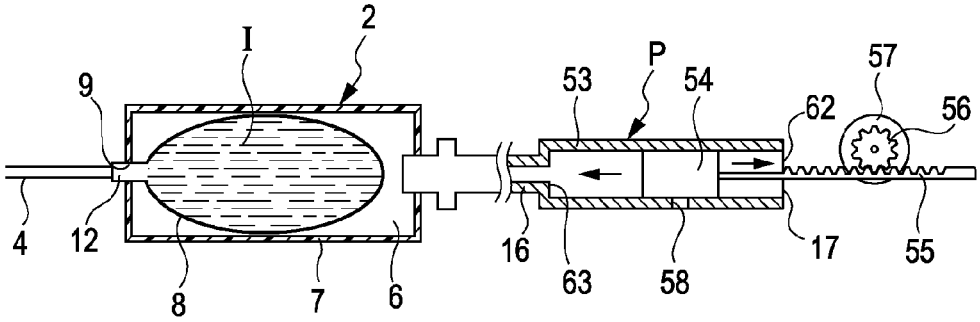
FIG. 14 is a diagram that schematically illustrates an example of the configuration of a printing apparatus according to another exemplary embodiment of the invention.

As still another embodiment, a piston-type pump may be used as the pressurizing/depressurizing pump P as illustrated in FIG. 14. A printing apparatus according to the present embodiment of the invention is provided with a cylinder 53, a piston 54, a rack 55, a gear 56, a speed reduction motor 57, and a hole 58. The hole 58 serves as an air open valve. When the speed reduction motor 57 is driven in one direction so that the piston 54 moves toward the bottom of the cylinder 53, the inner pressure of the cylinder 53 increases. Because of the increased inner pressure of the cylinder 53, the containing bag 8 is pressed from the outside. As a result, ink contained in the containing bag 8 is pressed out of the bag 8 and then flows through the ink supply passage 4. In this way, the ink is supplied to the head 3. On the other hand, when the speed reduction motor 57 is driven in the other direction so that the piston 54 moves toward the open end 62 of the cylinder 53, the inner pressure of the cylinder 53 decreases. Because of the depressurization of the cylinder 53, the inner pressure of the pressure chamber 6 also decreases. When the piston 54 passes through the position of the air-open-valve hole 58, the cylinder 53 is opened to air. When the cylinder 53 is opened to air, the pressure chamber 6 is also opened to air. Ink agitation control described in the foregoing exemplary embodiment of the invention can be performed with the illustrated piston-type pressurizing/depressurizing pump.

Figure 15:
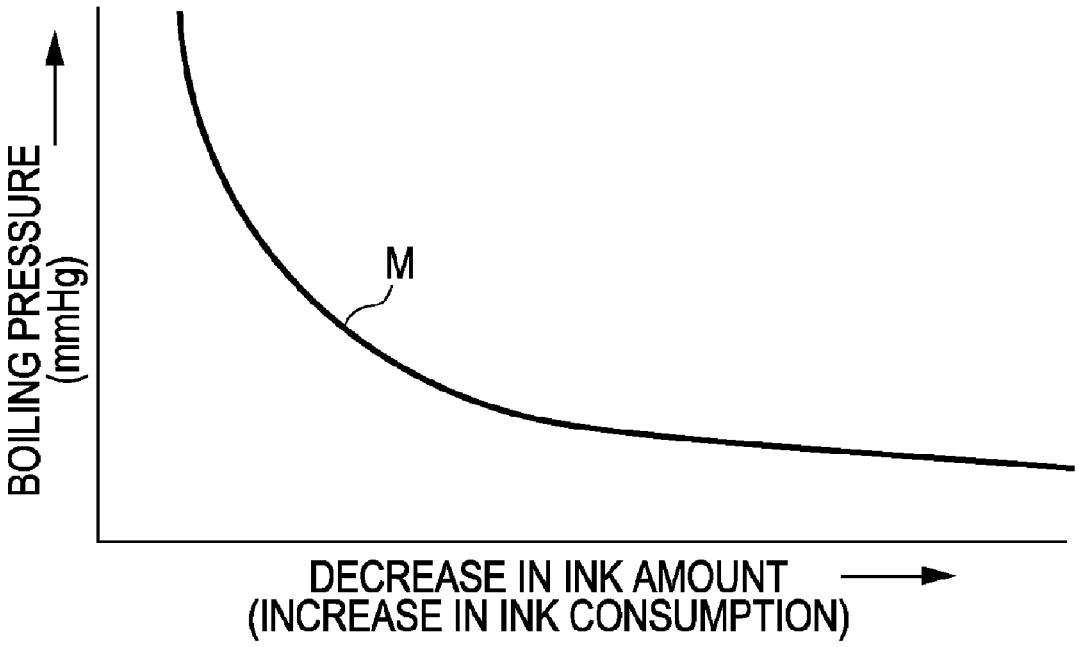
FIG. 15 is a graph that shows a characteristic curve representing boiling pressure in relation to a decrease in the amount of ink according to another exemplary embodiment of the invention.

The cumulative amount of ink that is consumed by a printing apparatus increases usually with the passage of printing time. Therefore, the amount of ink contained in the containing bag 8 decreases gradually with the passage of printing time. As the amount of ink contained in the containing bag 8 decreases, so does the amount of air dissolved in the ink solvent. Therefore, the relationship between boiling pressure and the amount of ink changes as shown as characteristics M in FIG. 15. The boiling pressure is pressure at which ink comes to a boil. That is, the boiling pressure gradually decreases with the decreasing amount of ink. While taking the characteristics M into consideration, the control unit 5 may adjust a depressurization value so that the boiling pressure decreases as the amount of ink decreases.

By this means, it is possible to perform depressurization control properly. That is, wasteful pressure control such as over-depressurized air opening or under-depressurized air opening can be avoided.

In this embodiment, the depressurization value is adjusted on the basis of the detected amount of ink that is contained in the containing bag 8. The amount of ink that is contained in the containing bag 8 can be detected by means of a weight sensor, which measures the weight of the containing bag 8. Or, the ink amount can be detected by means of a shape sensor, which detects the shape of the containing bag 8. Or, the ink amount can be detected by means of a liquid level sensor, which detects the liquid surface of the ink contained in the containing bag 8.

A pressurizing pump that pressurizes the pressure chamber 6 and a depressurizing pump that depressurizes the pressure chamber 6 may be provided as two discrete components.

In the structure of the cartridge 2, the container's ink port 9 that supports the bag's ink port 12, the air inlet/outlet port 10 through which the pressure chamber 6 is in communication with the outside, and the release port 11 through which the pressure chamber 6 is in communication with the outside may be provided on the same single side of the container 7. With such a structure, it is possible to easily attach the cartridge 2 to the cartridge attachment portion.

In the foregoing exemplary embodiment of the invention, it is explained that the liquid component of ink is vaporized by flash boiling to produce air bubbles in the ink. As a modification example, air (gas) dissolved in ink may be formed into air bubbles by flash boiling. Even when air dissolved in ink is formed into air bubbles without vaporizing the liquid component of the ink, the same advantageous effects as those explained earlier can be produced. The larger the amount of air dissolved in ink before depressurization is, the larger the amount of air bubbles formed is.

To increase the amount of air dissolved in ink before depressurization, as illustrated in FIG. 1, the upstream part 4*a* of the ink supply passage 4, which is in communication with the containing bag 8, is preferably made of a material that is permeable to air. The upstream part 4*a* of the ink supply passage 4 is a part between the cartridge 2 and the outlet valve V1. For example, the upstream part 4*a* of the ink supply passage 4 may be made of a low-density polyethylene tube, a silicon tube, or the like. In addition, at least a part of the containing bag 8 may be made of an air-permeable member. For example, at least a part of the containing bag 8 may have a single-layer structure that is made of a polyethylene film or a double-layer structure that includes a polyethylene film as the inner layer and a polyamide film or polyethylene terephthalate as the outer layer. In the above structure, the upstream part 4*a* of the ink supply passage 4 and the part of the containing bag 8 that is made of the air-permeable member constitute an example of an air-permeable section according to an aspect of the invention.

With such a structure, air is taken in through the upstream part 4*a* of the ink supply passage 4 and the part of the containing bag 8 that is made of the air-permeable member. Therefore, it is possible to increase the amount of air dissolved in ink contained in the containing bag 8. Air dissolved in ink at the upstream part 4*a* is diffused due to air taken in through the upstream part 4*a*. The diffused air is additionally dissolved in ink contained in the containing bag 8. Therefore, it is possible to achieve greater ink agitation effects utilizing air bubbles formed due to depressurization.

In addition, since ink contained in the containing bag 8 comes to a boil at reduced pressure with the increased amount of air dissolved therein, which is increased by returning the inner pressure of the pressure chamber 6 to atmospheric pressure after pressuring the pressure chamber 6 and by subsequently depressurizing the pressure chamber 6, it is possible to achieve further greater ink agitation effects utilizing air bubbles formed due to depressurization. When water-based ink is used, depressurization of approximately 100 kPa at normal temperature is necessary for vaporizing the liquid component of ink by flash boiling. In a case where air dissolved in ink is formed into air bubbles, depressurization at such a high depressurization level is not necessary on the condition that the amount of air dissolved in the ink is sufficiently large. Therefore, an inexpensive tube pump that has a comparatively low capability may be used.

Moreover, as illustrated in FIG. 1, the downstream part 4*b* of the ink supply passage 4, which is a part between the outlet valve V1 and the head 3, may be made of a material that is not permeable to air. The downstream part 4*b* of the ink supply passage 4 is an example of an air-impermeable section according to an aspect of the invention. The downstream part 4*b* of the ink supply passage 4 is a pipe made of metal such as stainless steel (e.g., SUS304) or the like when the head 3 is a fixed-type head. When the head 3 is a movable-type head, the downstream part 4*b* is, for example, a flexible tube that has a triple-layer structure that includes two polyethylene films as the outer layers and a thin film of either EVOH (ethylene vinyl alcohol copolymer resin) or PVDC (polyvinylidene chloride resin) being sandwiched between the two polyethylene films as the inner layer. Each of EVOH and PVDC is a synthetic resin that is known to have high gas-barrier characteristics. With the use of an air-impermeable material for the downstream part 4*b* of the ink supply passage 4, it is possible to prevent air from being dissolved in ink that flows through the downstream part 4*b*, thereby reducing poor ejection of ink from the head 3. In the recitation of appended claims, the term "air" encompasses the meaning of air and any other gas.

An ink-jet printer is taken as an example in the foregoing description of exemplary embodiments of the invention. However, needless to say, the scope of the invention is not limited to an ink-jet printer. The invention can be applied to various liquid ejecting apparatuses that eject or discharge various kinds of liquid that includes ink but not limited thereto and to various liquid containers that contain the liquid. In addition, the invention can be applied to various microdrop liquid ejecting apparatuses that are provided with microdrop liquid ejecting heads for discharging liquid drops whose amount is minutely small. Herein, a "liquid drop" is a form or a state of liquid in the process of ejection of the liquid from a liquid ejecting apparatus. The liquid drop encompasses, for example, a particulate drop, a tear-shaped drop, and a viscous/thready drop that forms a thread tail, without any limitation thereto. The "liquid" may be made of any material as long as a liquid ejecting apparatus can eject it. The liquid may be made of any substance as long as it can be in a liquid phase. It may have high viscosity or low viscosity. It may be sol or gel water. Or, it may be fluid that includes, without any limitation thereto, inorganic solvent, organic solvent, solution, liquid resin, and liquid metal (e.g., metal melt). The "liquid" is not limited to liquid as a state of a substance. It encompasses a liquid/liquefied matter/material that is made as a result of dissolution, dispersion, or mixture of particles of a functional material made of a solid such as pigment, metal particles, or the like into/with a solvent, though not limited thereto. Besides ink explained in the foregoing exemplary embodiments, liquid crystal is a typical example of the liquid. Besides popular water-based ink explained in the foregoing exemplary embodiments, "ink" encompasses various types of ink having liquid composition such as oil-based ink, gel ink, hot melt ink, or the like. Examples of various liquid ejecting apparatuses are: an apparatus that ejects liquid in which, for example, a material such as an electrode material, a color material, or the like that is used in the production of a liquid crystal display device, an organic EL (electroluminescence) display device, a surface/plane emission display device, a color filter, or the like is dispersed or dissolved, an apparatus that ejects a living organic material that is used for production of biochips, an apparatus that is used as a high precision pipette and ejects liquid as a sample, a textile printing apparatus, a micro dispenser, and the like. In addition, the invention is applicable to and can be embodied as a liquid ejecting apparatus that ejects, with high precision, lubricating oil onto a precision instrument and equipment including but not limited to a watch and a camera. Moreover, the invention is applicable to and can be embodied as a liquid ejecting apparatus that ejects liquid of a transparent resin such as an ultraviolet ray curing resin or the like onto a substrate so as to form a micro hemispherical lens (optical lens) that is used in an optical communication element or the like. Furthermore, the invention is applicable to and can be embodied as a liquid ejecting apparatus that ejects an etchant such as acid or alkali that is used for the etching of a substrate or the like. Without any intention to limit the technical scope of the invention to those enumerated or explained above, the invention can be applied to a variety of ejecting apparatuses that eject or discharge various kinds of fluid, liquid, or the like such as those enumerated or explained above.

The entire disclosure of Japanese Patent Application Nos. 2008-256078, filed Oct. 1, 2008, 2009-179232, filed Jul. 31, 2009 are expressly incorporated by reference herein.

What is claimed is:

1. A liquid ejecting apparatus comprising:

a head that ejects a liquid;

a liquid containing section that contains the liquid is provided inside a liquid containing chamber;

a liquid supply passage that supplies the liquid from the liquid containing section to the head;

a passage valve that is provided on the liquid supply passage;

a depressurizing section that brings the liquid contained in the liquid containing section to a boil at reduced pressure; and an air open valve that opens an inner chamber space of the liquid containing chamber to air after the boiling of the liquid at the reduced pressure;

wherein the depressurizing section is driven with the passage valve closed and the air open valve is opened after the depressurizing section has been driven when the passage valve is closed.

2. The liquid ejecting apparatus according to claim 1, at least a part of the liquid containing section having flexibility, wherein the liquid is contained in the liquid containing section inside the liquid containing chamber.

3. The liquid ejecting apparatus according to claim 2, wherein the liquid containing section is made of an air-impermeable member, which is not permeable to air.

4. A liquid ejecting apparatus comprising:

a liquid ejecting head that ejects a liquid;

a liquid supply passage;

a liquid containing section that contains the liquid is provided inside a liquid containing chamber, the liquid containing section being in communication with the liquid ejecting head through the liquid supply passage;

a passage valve that is provided on the liquid supply passage;

an air-permeable section through which air can be taken in to be dissolved in the liquid contained in the liquid containing section;

a depressurizing section that depressurizes an inner chamber space of the liquid containing chamber to form the air dissolved in the liquid contained in the liquid containing section into air bubbles, wherein the depressurizing section is driven with the passage valve closed; and an air open valve that opens the inner chamber space of the liquid containing chamber to air after the depressurization, wherein the air open valve is opened after the depressurizing section has been driven with the passage valve closed.

5. The liquid ejecting apparatus according to claim 4, wherein the passage valve is provided at an intermediate position on the liquid supply passage, the passage valve being able to open or close the liquid supply passage, wherein a part of the liquid supply passage between the liquid containing chamber and the passage valve is the air-permeable section; and a part of the liquid supply passage between the liquid ejecting head and the passage valve is an air-impermeable section, which is not permeable to air.

6. The liquid ejecting apparatus according to claim 4, at least a part of the liquid containing section being made of an air-permeable member, which is permeable to air, wherein the liquid is contained in the liquid containing section inside the liquid containing chamber; and the part of the liquid containing section that is made of the air-permeable member constitutes a part of the air-permeable section.

7. The liquid ejecting apparatus according to claim 6, further comprising a pressurizing section that pressurizes the inner chamber space of the liquid containing chamber, wherein the depressurizing section depressurizes the inner chamber space of the liquid containing chamber to form the air dissolved in the liquid contained in the liquid containing chamber into air bubbles after the pressurization of the inner chamber space of the liquid containing chamber by the pressurizing section.

* * * * *